United States Patent [19]

Hofstetter

[11] 3,981,411

[45] Sept. 21, 1976

[54] SAFETY CAN OPENER

[76] Inventor: Robert A. Hofstetter, 1715 Rada Road, Hacienda Heights, Calif. 91745

[22] Filed: Jan. 26, 1976

[21] Appl. No.: 652,160

[52] U.S. Cl. ..... 220/267; 220/268; 220/277; 222/81

[51] Int. Cl.[2] ..... B65D 41/32

[58] Field of Search ..... 220/267, 268, 269, 277; 222/81–83, 541

[56] References Cited

UNITED STATES PATENTS

| | | | |
|---|---|---|---|
| 3,807,597 | 4/1974 | Wells et al. | 220/277 |
| 3,860,143 | 1/1975 | Strore et al. | 220/269 |
| 3,924,777 | 12/1975 | Peyser | 220/277 |

*Primary Examiner*—George T. Hall

[57] ABSTRACT

This device consists primarily of a pivotable tab, which normally rests within a well recessed in the top of a can, the tab being lifted upwards from the well portion, when it is desired to open the can of liquid. The tab portion is provided with nipples, which will enable the tab, when rotated, to align with a scored line on the top of the can, which when cut out by pressing the tab downwards, will enable the liquid to be dispensed from the can.

5 Claims, 14 Drawing Figures

SAFETY CAN OPENER

This invention relates to cans having self contained opener means, and more particularly to a safety can opener.

It is therefore the principal object of this invention to provide a safety can opener, which will remain affixed to a can containing liquid, and will prevent the user from possibly cutting a finger, as many times occurs with openers in cans of the prior art.

Another object of this invention is to provide a safety can opener, which normally will rest within a recessed well or opening within the top of the can, and the tab of the opener may be lifted from the recessed opening, and rotated to align with it a scored line in the top of the can, so that when the top is urged downwards, the lower edge of the tab will shear the scored line, so as to enable liquid from within the can to be dispelled therefrom.

A further object of this invention is to provide an opener of the type described, which will have nipple means on the tab, which will serve as stop means for the alignment of the tab with the scored lines, the nipples being received within depressions in the top of the can.

A still further object of this invention is to provide an opener, of the type described, which will have an angular edge so as to effect the proper shearing of the scored line, the liquid being dispensed from openings in the tab.

Other objects of the invention are to provide a safety can opener, which is simple in design, inexpensive to manufacture, rugged in construction, easy to use and efficient in use.

These and other objects will be readily evident upon a study of the following specification and the accompanying drawings, wherein.

Figure 13A:
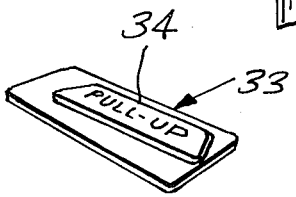
FIG. 13 is a perspective view of the tab device of FIG. 8.
Figure 13:
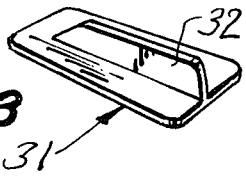
Figure 12:
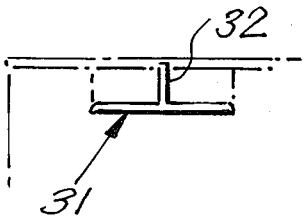
FIG. 12 is a diagrammatic view showing the tab of FIG. 13, urged downwards for the release of the liquid in the can.

FIG. 13*a* is similar to FIG. 13, but shows a pull-up tab portion.

According to this invention, a safety can opener 10 is pivotably secured to can 11 on its top surface 12, and is spaced from a scored line 13 on top 12. A recessed well, or opening 14, within top 12, is off set from the center of the top 12, and the pivotable tab 15 normally rests within opening 14, until it is desired to open the can 11 to dispel the contents therefrom.

Tab 15 is provided with a finger grip opening 16 and is pivotably secured to top 12 by suitable fastener means 17. Tab 15 is pivotable in either direction, as indicated by the arrows 18, so as to align with the scored line 13 when it is desired to open can 11. Tab 15 is lifted by the user from opening 14 within top 12, and is aligned with the scored line 13, automatically, by means of the spaced apart nipples 19, which engage with the recesses 20 which form stop means, for the alignment of tab 15 with scored line 13. Tab 15 is provided with a plurality of openings 21 through which the liquid contents are dispensed, when the scored line 13 is sheared by tab 15. The bottom edge 22 of tab 15 is sloped, so as to provide the necessary shearing action for shearing the scored line 13 when tab 15 is urged downwards by the user.

Tab 15 is also provided with an outwardly projecting nipple 23, which will engage the under side of top 12, when tab 15 is in its urged down position, the nipple 23 thus serving as stop means for keeping the can 11 open.

Figure 1:
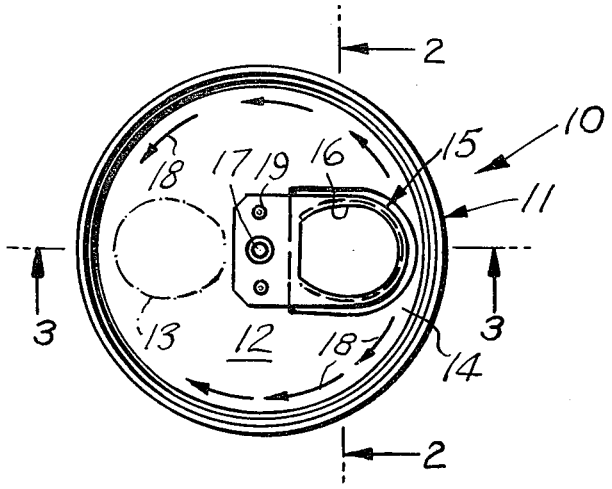
FIG. 1 is a top plan view of the present invention.
Figure 2:
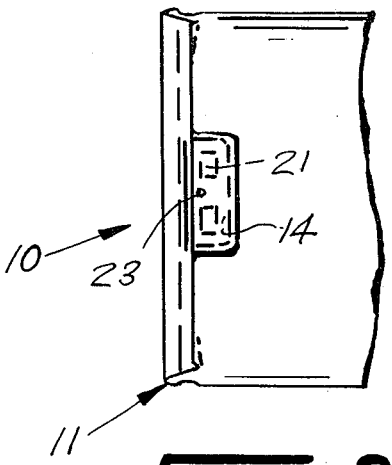
FIG. 2 is a diagrammatic cross sectional view taken along the line 2—2 of FIG. 1.
Figure 3:
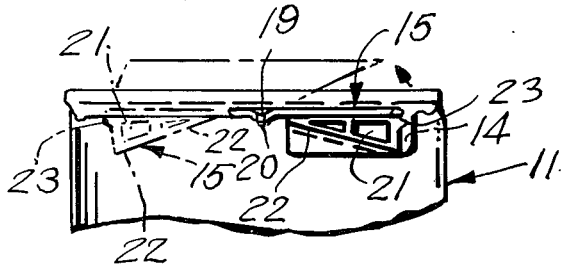
FIG. 3 is a diagrammatic cross sectional view taken along the line 3—3 of FIG. 1.
Figure 5:
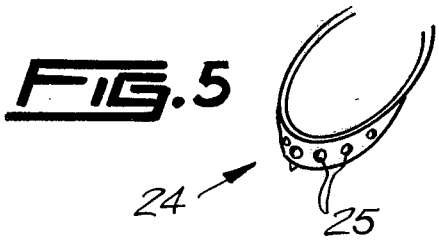
FIG. 5 is a fragmentary perspective view showing a modified tab.
Figure 6:
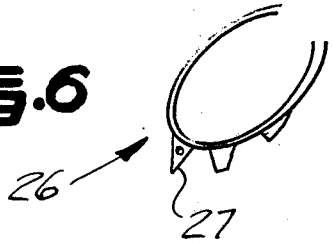
FIG. 6 is similar to FIG. 5, but shows another modified form of the tab.
Figure 4:
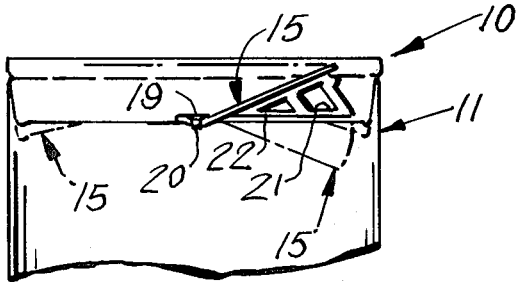
FIG. 4 is similar to FIG. 3, and shows all the positions of the tab.
Figure 7:
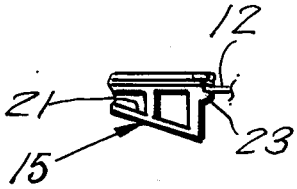
FIG. 7 is a fragmentary side view of the tab shown retained within the sheared opening.

Referring now to FIG. 5 of the drawing, a modified tab 24 is shown to include a plurality of spaced apart circular openings, and in FIG. 6, a modified form of tab 26 is shown to have projections 27, which are spaced apart from each other.

Figure 8:
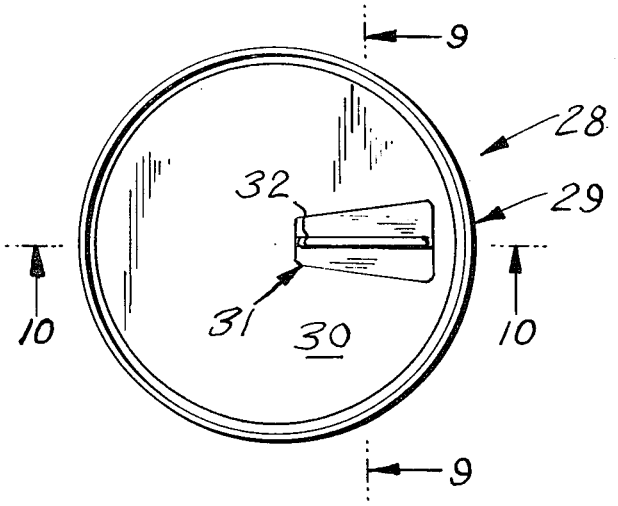
FIG. 8 is a top plan view showing a modified form of the invention.
Figure 9:
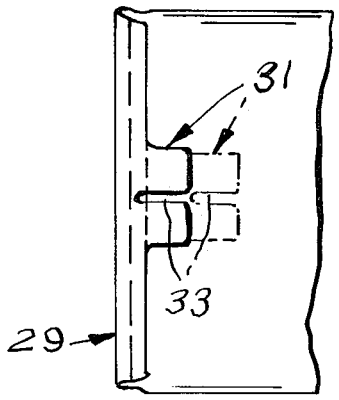
FIG. 9 is a diagrammatic cross-sectional view taken along the line 9—9 of FIG. 8.
Figure 10:
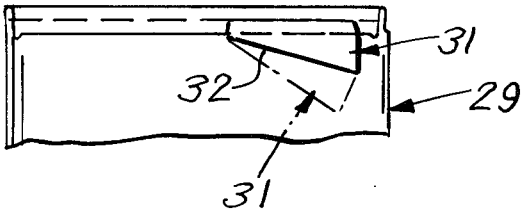
FIG. 10 is a diagrammatic cross-sectional view taken along the line 10—10 of FIG. 8.

Referring now to FIG. 8, a modified opener 28, of can 29, is shown to consist of a top 30, to which is affixed a tab 31. Tab 31 is provided with projecting lip 32, which extends upwards from top 30, and provides finger grip means for urging tab 31 downwards, which will shear an opening in top 30, so as to release the liquid therefrom.

Referring now to FIG. 13*a*, a modified form of tab 33 is shown to have a pull-up lip 34, which is bent upward, when it is desired to urge the tab 33 downwards, the operation being similar to that described of tab 31.

Figure 11:
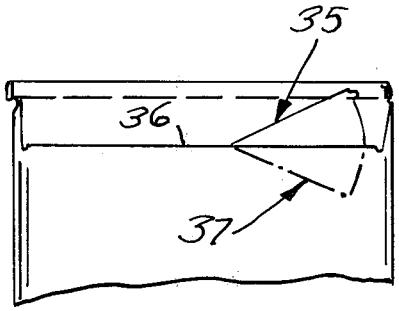
FIG. 11 is similar to FIG. 10, but shows a modified form.

Referring now to FIG. 11, a modified design is shown to include a tab 35, which extends upwards at an angle from top 36, and when urged downwards will assume the position as shown by the phantom lines 37.

What I now claim is:

1. A safety can opener, comprising a liquid containing can, a pivotable tab secured to the top of said can in recessed means of the top, shearing edge means on said tab for shearing an opening in the top of said can, indentation and nipple means on said can, providing stop means for the alignment of said tab with a scored line, and means for retaining said tab within the opening that is defined by said scored lines.

2. The combination according to claim 1, wherein one end of said tab is freely received within said recessed opening in the top of said can, and the opposite end of said tab is secured fixedly and pivotably to the top of said can by suitable fastener means, and the bottom edge of said tab is angularly sloped, so as to shear an opening in the top of said can on the scored line adjacent to said tab.

3. The combination according to claim 2, wherein said tab is provided with a plurality of spaced apart openings on its outer peripheral side edges for the flow of liquid therefrom, and nipple means projecting outwards from the large surface peripheral area of said tab abuts with the underside of the top of said can, when said tab is urged downwards, and shears said scored line, and nipple means on the underside of said tab are spaced from the fastener securing said tab to the top of said can.

4. The combination according to claim 3, wherein said nipple means, spaced apart from said fastener, are removably received within depressions in the top of said can, thus forming stop means for said tab when it is rotated, so as to align the shearing edge of said tab with the scored line.

5. The combination according to claim 4, wherein said recessed opening in the top of said can aligns with similar grip opening means of said tab.

* * * * *